US005459881A

United States Patent [19]

Fagan et al.

[11] Patent Number: 5,459,881

[45] Date of Patent: Oct. 24, 1995

[54] COMBINATION HAT WITH PONCHO

[75] Inventors: Patricia A. Fagan, Upper Montclair; Joyce S. Zakierski-Simmons, Sparta, both of N.J.

[73] Assignee: J P Productions, Upper Montclair, N.J.

[21] Appl. No.: 207,952

[22] Filed: Mar. 8, 1994

[51] Int. Cl.[6] ..... A41D 13/00; A42B 1/00; A42B 1/06

[52] U.S. Cl. ..... 2/209.13; 2/84; 2/88

[58] Field of Search ..... 2/171, 171.1, 171.4, 2/175.1, 175.3, 209.11, 209.13, 88, 84, 823, 824, 866

[56] References Cited

U.S. PATENT DOCUMENTS

| | | | |
|---|---|---|---|
| D. 57,532 | 4/1921 | Lazar | D2/823 |
| 993,257 | 5/1911 | Kopp | 2/175.3 |
| 2,745,104 | 5/1956 | Persico et al. | 2/88 |
| 3,469,264 | 9/1969 | Harris | 2/209.3 X |
| 3,496,575 | 2/1970 | Neckermann et al. | 2/171 |
| 4,064,562 | 12/1977 | Kenny | 2/84 |
| 4,598,725 | 7/1986 | Brewer | 135/95 |
| 4,980,928 | 1/1991 | Ellis | 2/88 |
| 5,048,128 | 9/1991 | Watson, Jr. | 2/204 |
| 5,144,695 | 9/1992 | Schweizer | 2/209.13 X |
| 5,212,837 | 5/1993 | Gose et al. | 2/209.13 X |
| 5,297,295 | 3/1994 | Barbeau | 2/141.1 X |
| 5,303,427 | 4/1994 | Fishbaine | 2/209.11 |

FOREIGN PATENT DOCUMENTS 403568 12/1933 United Kingdom .

*Primary Examiner*—C. D. Crowder
*Assistant Examiner*—Shirra L. Jenkins
*Attorney, Agent, or Firm*—Weingram & Zall

[57] ABSTRACT

A combination headgear and poncho is provided which includes a hat having a crown portion with a liner disposed therein for forming a compartment in which the poncho is contained. The liner is formed with an aperture through which the poncho is extracted from or inserted into the compartment. Complimentary fastening means, such as hook and pile materials, are disposed at the liner along the aperture to secure the compartment. The crown portion is also provided with gathering means which operatively adapts the crown portion to snugly fit the wearer's head when the poncho is contained in the compartment or when the poncho has been removed from the compartment and deployed, resulting in the weight of the crown portion being reduced.

20 Claims, 2 Drawing Sheets

COMBINATION HAT WITH PONCHO

BACKGROUND OF THE INVENTION

1. Field of the Invention

This invention relates to headgear and particularly to hats which are adapted to contain capes, ponchos and the like for deployment.

2. Background of the Invention

Headgear with ponchos, capes and the like are known, examples of which can be found in U.S. Pat. Nos. 4,064,562 to Kenny, 4,980,928 to Ellis, 5,048,128 to Watson, Jr. and 5,212,837 to Gose et al.

In addition, it is known to adapt hood or cape articles for application to headgear and coats, as well as to use these articles as a cover for bicycles, ground cover, or as protective rainwear for a rider. See U.S. Pat. Nos. 2,745,104 to Persico et al., 4,598,725 to Brewer, and Great Britain Patent No. 403,568 to Wantky.

However, among the patents disclosing headgear with ponchos, capes or the like, none of these patents disclose a hat containing a poncho therein for deployment, which hat includes means to adjustably secure a crown portion of the hat to the head of the wearer so that the crown portion is secured comfortably regardless of whether the poncho is stored in the crown portion or is deployed. This advantage of the present invention over the known headgear becomes apparent during windy conditions when the less than secure crown portion of the hat shifts unwantedly or is blown off the wearer's head completely.

OBJECTS AND SUMMARY OF THE INVENTION

It is an object of the present invention to provide a hat which is comfortable to wear and which contains a compartment for storing a poncho.

It is another object of the present invention to provide a hat compartment which is easily accessible for deploying the poncho stored within.

It is a further object of the present invention to provide a poncho which is completely removable from the hat for deployment or removably mountable to the hat during deployment.

It is a further object of the present invention to provide a hat with a crown portion having means to secure the crown portion comfortably to the wearer's head when the poncho is contained in the compartment and when the poncho has been deployed.

It is a further object of the present invention to provide a brim for the hat which has a diameter sufficient to support the securing means away from the head, face and neck of the wearer.

It is a further object of the present invention to provide a hat which is easy to manufacture, maintain and clean.

The foregoing objects are accomplished by this invention which comprises a combination headgear and protective covering such as a hat with poncho, wherein the hat includes a crown portion formed with a compartment disposed therein for containing the poncho, means for accessing the compartment, and means for gathering material of the hat to secure the hat to a wearer's head when the poncho is either disposed in or removed from the compartment for deployment.

The combination hat and poncho, according to the present invention, further includes a liner disposed within the crown portion of the hat to form a wall for the compartment, the liner having an aperture therethrough to permit access to the compartment so that the poncho can be stored or removed for deployment.

The present invention also provides for a hat having a poncho which can be removably secured to the compartment in the crown portion so that the poncho can preferably be secured to the hat during deployment.

BRIEF DESCRIPTION OF THE DRAWINGS

For a more complete understanding of the present invention, reference may be had to the following descriptions of exemplary embodiments of the present invention considered in connection with the accompanying drawings, in which.

DESCRIPTION OF THE PREFERRED EMBODIMENTS

Figure 1:
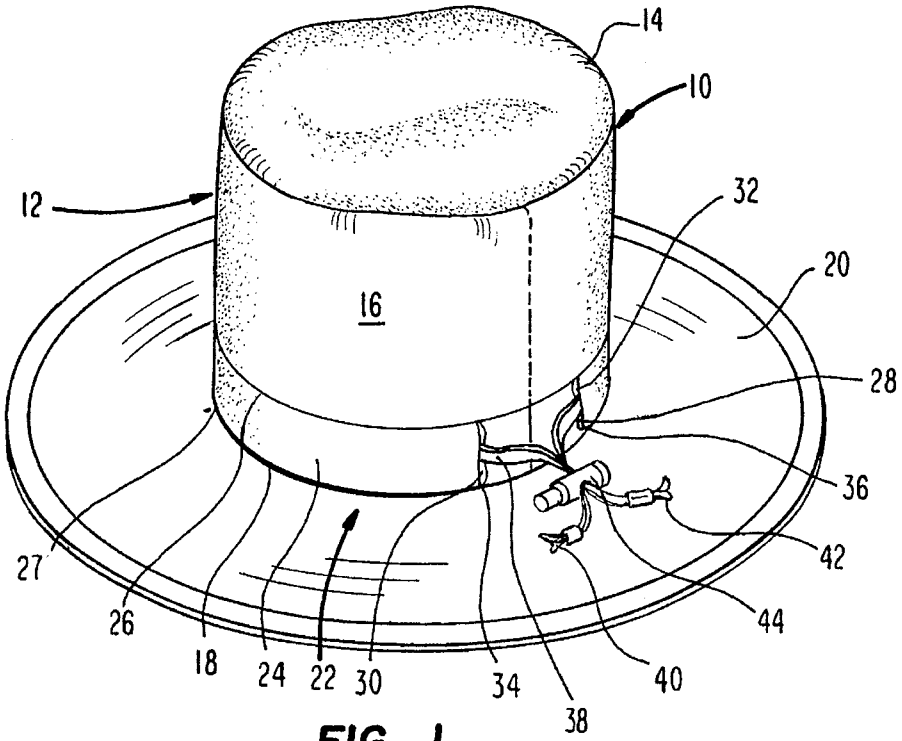
FIG. 1 is a top perspective view of a preferred embodiment of a combination hat with poncho according to the present invention, and which shows means to adjustably secure a crown portion of the hat to the wearer.

FIG. 1 shows a first embodiment of the present invention which includes headgear such as a hat 10 consisting of a crown portion 12 to be worn on the head of the wearer. The crown portion 12 includes a top 14 and a continuous sidewall 16 connected thereto and which extends to a lower peripheral edge 18. A brim portion 20 extends outward from the lower peripheral edge 18 of the crown portion 12. Elements of the crown portion are secured to each other by stitching, gluing or other fastening methods known in the art.

A means 22 for gathering the crown portion 12 includes a rectangular-shaped piece of material 24, or fabric strip, which extends around the base of the crown portion 12. The lengthwise edges 26, 27 of the rectangular strip 24 of fabric are secured to the crown portion 12 so that a space 28 is provided between the fabric strip and the surface of the crown portion. Ends 30, 32 of the strip are disposed adjacent to each other and are not secured entirely to the surface of the crown portion 12, thereby providing slit-like apertures 34, 36 for access to the space 28.

Disposed within the space 28 is a string-like member 38 having opposed ends 40, 42 each of which protrudes from a corresponding one of the apertures 34, 36 at the ends of the fabric strip 24. The string 38 moves freely within the space. The string ends 40, 42 are threaded through a cinching device 44 which is adapted to be moved along the string 38 between the ends 40, 42. Cinching device 44 when moved toward the crown 12 along string 30 tightens the base of the crown portion 12 to adjustably secure the crown portion to the wearer's head. Alternatively, the gathering means 22 can be manufactured as a separate assembly including string member 38 and cinching device 44 and secured to the base of the crown portion 12. The brim 20 supports the gathering means, as shown in FIG. 3, so that the gathering means does not impede the wearer's line of sight or dangle uncomfortably on the wearer's neck and face.

Figure 2:
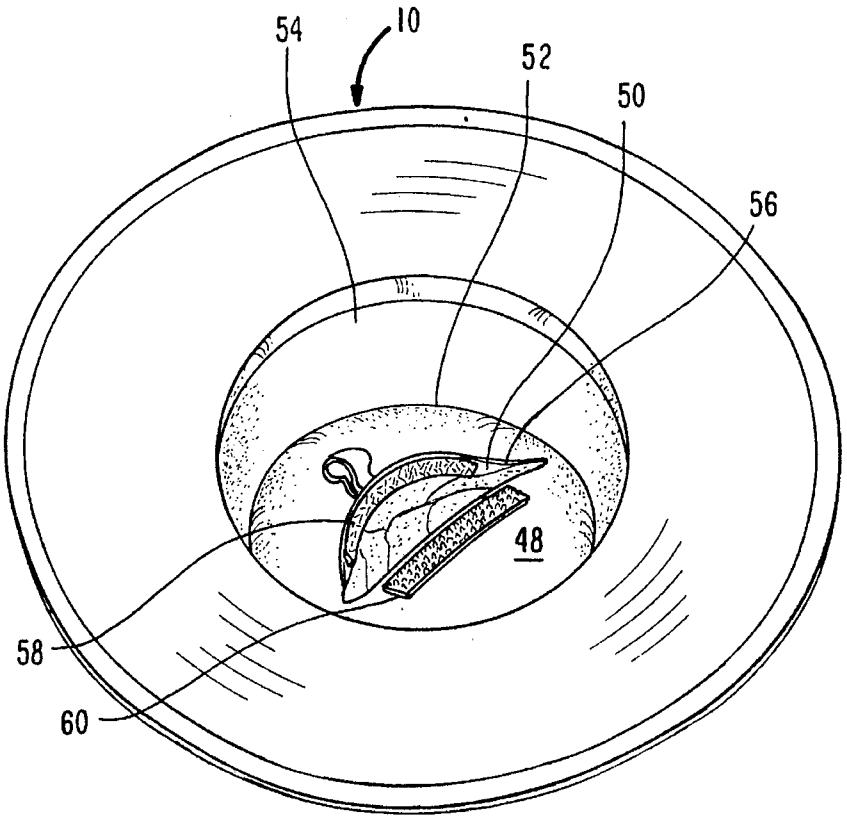
FIG. 2 is a bottom perspective view of the present invention showing an interior of the crown portion and means to access a compartment of the crown portion and secure the poncho contained therein.

FIG. 2 shows the interior of the crown portion 12 adapted to receive and contain a poncho 46 or other protective covering for deployment. A circular piece of fabric 48 formed with an aperture 50 therethrough and having a peripheral edge 52 is employed as a liner and disposed within and secured to the inner surface 54 of the crown portion 12 along the peripheral edge 52. A space is formed between the liner 48 and the top 14 of the crown portion 12, which space functions as a compartment 56 accessible through the aperture 50. The size of the poncho 46 to be contained will determine the size of the compartment 56 and also, the position of the liner 48 with respect to the top 14. The liner 48 is provided with closure means 58, 60 to securely close the aperture 50 to contain the poncho in the compartment. Closure means known in the art can be employed and it is preferred to use the hook and pile type fasteners which enable quick mating engagement and are comfortable when in contact with the wearer's head. One of a hook and pile type fastener can be disposed on the liner 48 along one side of the aperture 50, while another one of a hook and pile type fastener can be disposed along the liner at the opposite side of the aperture for releasable engagement with each other.

Figure 3:
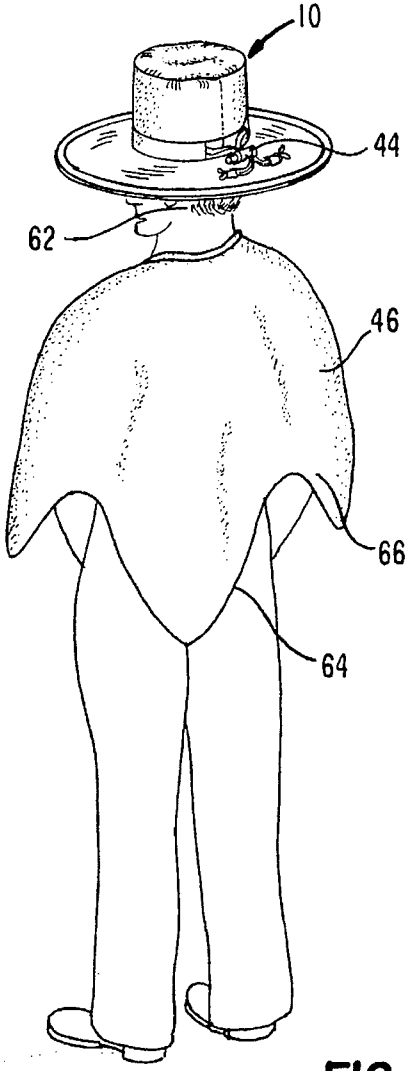
FIG. 3 is a perspective view of the present invention showing the securing means being employed to secure the crown portion of the hat to the wearer and the poncho deployed for use.

As shown in FIG. 3, the poncho 46 has been removed from the compartment 56 and the crown portion 12 of the hat and deployed for use. Prior to the poncho 46 being deployed, and with the poncho stored in the compartment 56, the gathering means 22 was employed to secure the crown portion of the hat to the wearer's head 62. With the poncho now deployed, the crown portion 12 is not as snugly secured to the wearer's head because the displacement of the poncho material has resulted in excess material being present along the base of the crown portion at the gathering means 22. To compensate for the loss of the poncho bulk, the gathering means is used so that the hat 10 is snugly secured to the wearer's head as previously discussed with reference to FIG. 1. This is accomplished by moving the cinching means 44 along the string 38 toward the crown portion 12. This in turn gathers the material at the base of the crown portion to more snugly contact the wearer's head. A peripheral edge 64 of the poncho 46 may be formed to provide triangular-shaped portions 66 to further protect the wearer from the elements, yet maintain freedom of arm movement.

Figure 4:
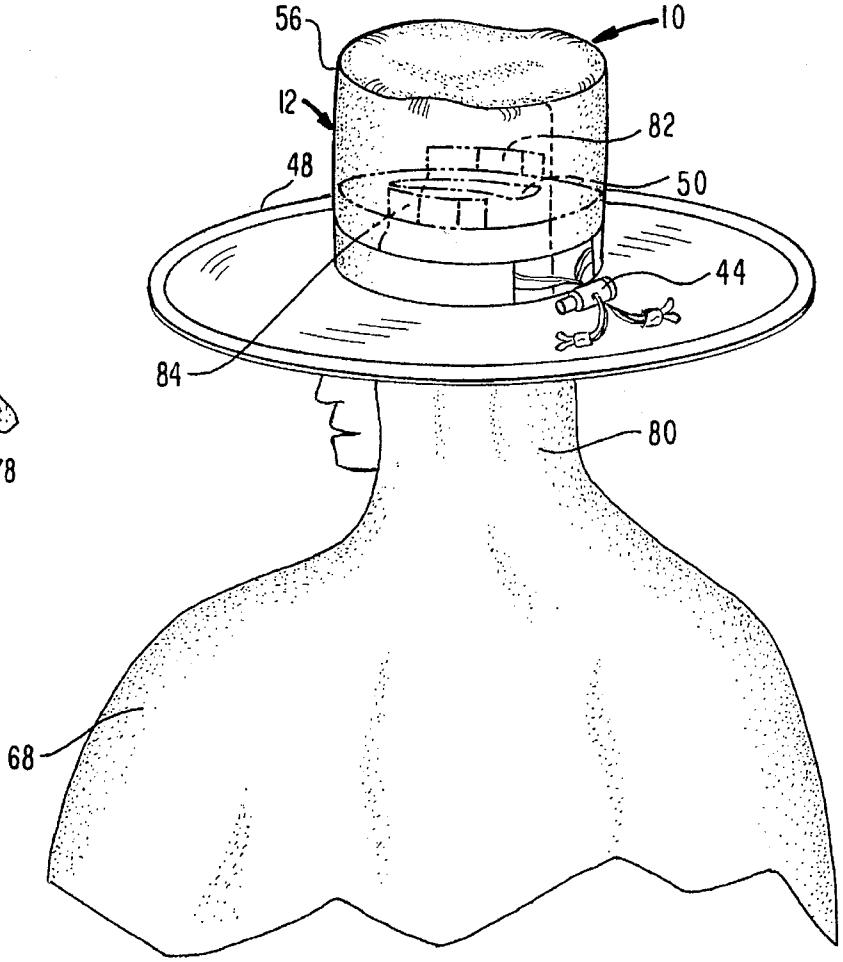
FIG. 4 is a perspective view of a second embodiment of the present invention wherein the poncho is removably mountable to the hat.

FIG. 4 shows another embodiment of the present invention, with elements which are similar to those discussed with reference to the first embodiment being identified by the same reference numbers.

In the second embodiment, a poncho 68 is removably mountable to the crown portion 12 at the interior of the compartment 56. The poncho 68 is removably secured to the compartment 56 by hook and pile type fasteners 82,84 so that when the poncho is removed from the compartment and deployed for use, it remains secured to the crown portion 12 of the hat 10. If desired, the poncho 68 can be removed entirely from the hat 10. The poncho 68 of this embodiment includes an extended portion 80 to further protect the neck and head of the wearer.

Figure 5:
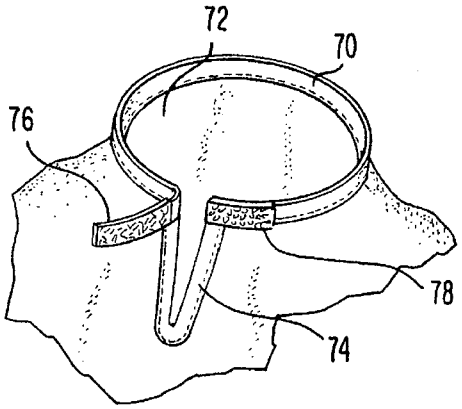
FIG. 5 is a front perspective view of the poncho in FIGS. 3 and 4 having means to accommodate and adjustably secure the poncho about the wearer's neck.

FIG. 5 shows a collar portion 70 of the poncho. The poncho has an aperture 72 through which the wearer's head 62 is inserted so that the poncho rests on the wearer's shoulders. A V-cut 74 is formed in the material adjacent to the collar aperture 72 so that the poncho will spread to permit easy insertion of the head through the material. Hook and pile type fasteners 76, 78 are employed to secure in mating engagement opposed ends of the collar 70 at the V-cut 74 so that the collar portion of the poncho can be adjusted for comfortable securement about the wearer's neck.

In operation, the hat 10 is worn in the conventional manner and the gathering means 22 enables the wearer to comfortably adjust the crown portion 12 to securely fit the head, despite the compartment 56 containing the bulk of material for the poncho 46, 68. If the climate dictates that the poncho is to be worn, the wearer merely removes the hat, disengages the closure means 58, 60 within the crown portion to access the compartment 56 in which the poncho is contained, and removes the poncho through the aperture 50 in the liner for deployment. The hat is returned to the wearer's head and the gathering means 22 actuated to snugly secure the base of the crown portion 12 to the wearer's head to compensate for the loss of the poncho material when the same was removed from the compartment. In this manner, because the crown portion is adjustable, the hat will remain comfortably secured to the wearer's head. The wearer can be confident that the shape of the crown portion is maintained and the hat will not be blown away should a gust of wind arise.

The hat is preferably formed of materials or fabrics treated to resist wet and harsh climates and to facilitate washing and the rejection of stains. It is also preferred that the fabric or material employed to manufacture the hat be pliable to facilitate storage and packing.

It will be understood that the embodiments described herein are merely exemplary and that a person skilled in the art may make many variations and modifications without departing from the spirit and scope of the invention. Such modifications and variations are intended to be included within the scope of the invention as defined in the appended claims.

What is claimed is:

1. A combination headgear and protective covering, comprising:

a crown portion, a flexible liner formed with an opening therethrough, the flexible liner disposed within the crown portion and joined thereto for forming a compartment in the crown portion accessed through the opening, a protective covering disposed in the compartment to contain the protective covering, first releasable securing means disposed in the compartment for releasably securing the protective covering therein for containment and deployment, second releasable securing means disposed on the protective covering for releasably securing the protective covering to the first releasable securing means in the compartment, and closure means disposed near the opening for releasable engagement to control access through the opening, the closure means constructed and arranged to permit the protective covering to be releasably secured in the compartment and deployable to cover a head and shoulders of a wearer, and when released from the compartment to cover an area of the wearer at the shoulders and below.

2. The combination headgear protective covering according to claim 1, wherein the first releasable securing means comprises hook and pile type fasteners disposed in spaced apart relationship in the compartment.

3. The combination headgear and protective covering according to claim 2, wherein the hook and pile type fasteners of the first releasable securing means are disposed at opposite sides of the compartment.

4. The combination headgear and protective covering according to claim 1, wherein the first releasable securing means is flexible.

5. The combination headgear and protective covering according to claim 1, wherein the first releasable securing means and the second releasable securing means coact to releasably secure the protective covering to the compartment and deploy the protective covering through the opening to substantially cover the head and the shoulders of the wearer when the head gear is positioned on the wearer's head.

6. The combination headgear and protective covering according to claim 1, further comprising:

means for gathering the crown portion to adjustably secure the crown portion to the wearer's head when the protective covering is contained in the compartment or deployed therefrom.

7. The combination headgear and protective covering according to claim 6, wherein the gathering means comprises:

a string-like member extending around the crown portion of the headgear, and means for adjusting slack in the string-like member, the adjusting means constructed to receive opposed ends of the string-like member and slide therealong to adjust the slack and thereby fit the crown portion to the wearer's head.

8. The combination headgear and protective covering according to claim 7, further comprising:

means for maintaining the string-like member around the crown portion, the maintaining means extending around the crown portion and spaced therefrom for providing a space in which the strip-like member is maintained, and a region for the opposed ends of the string-like member to extend from the space.

9. The combination headgear and protective covering according to claim 5, further comprising a brim joined to the crown portion to support the gathering means from dangling downward.

10. The combination headgear and protective covering according to claim 1, wherein the protective covering further comprises:

a peripheral edge having portions removed to form an alternating triangular pattern.

11. The combination headgear and protective covering according to claim 1, wherein the second releasable securing means is releasable from the first releasable securing means to remove the protective covering from the compartment to cover the wearer's shoulders while the headgear is positioned on the wearer's head.

12. The combination headgear and protective covering according to claim 1, wherein the closure means comprises a hook and pile type fastener disposed at one side of the opening and another one of a hook and pile type fastener disposed at an opposite side of the opening.

13. A combination headgear and protective covering, comprising:

a crown portion, a flexible liner formed with an opening therethrough, the flexible liner disposed within the crown portion and joined thereto for forming a compartment in the crown portion accessed through the opening, a protective covering disposed in the compartment for containing the protective covering, first releasable securing means disposed in the compartment for releasably securing the protective covering therein for containment and deployment, second releasable securing means constructed and arranged on the protective covering for releasably securing the protective covering to the first releasable securing means in the compartment, and for releasably securing the protective covering to a wearer's neck, and closure means disposed near the opening for releasable engagement to control access through the opening, the closure means constructed and arranged to permit the protective covering to be releasably secured in the compartment and deployable to cover a head and shoulders of a wearer, and when released from the compartment to cover an area of the wearer at the shoulders and below.

14. The combination headgear and protective covering according to claim 12, wherein the second releasable securing means is releasable from the first releasable securing means in the compartment to remove the protective covering from the compartment through the opening to cover the shoulders of the wearer.

15. The combination headgear and protective covering according to claim 12, wherein the first releasable securing means comprises fasteners disposed at opposite sides of the compartment.

16. The combination headgear and protective covering according to claim 12, wherein the first releasable securing means is flexible.

17. The combination headgear and protective covering according to claim 12, further comprising:

means for gathering the crown portion to adjustably secure the crown portion to the wearer's head when the protective covering is contained in the compartment or deployed therefrom.

18. The combination headgear and protective covering according to claim 17, wherein the gathering means comprises:

a string-like member extending around the crown portion of the headgear, and means for adjusting slack in the string-like member, the adjusting means constructed to receive opposed ends of the string-like member and slide therealong to adjust the slack and thereby fit the crown portion to the wearer's head.

19. The combination headgear and protective covering according to claim 18, further comprising:

means for maintaining the string-like member around the crown portion, the maintaining means extending around the crown portion and spaced therefrom for providing a space in which the strip-like member is maintained, and a region for the opposed ends of the string-like member to extend from the space.

20. The combination headgear and protective covering according to claim 12, wherein the closure means comprises a hook and pile type fastener disposed at one side of the opening and another one of a hook and pile type fastener disposed at an opposite side of the opening.

* * * * *